United States Patent [19]

Johnson et al.

[11] Patent Number: 4,611,213

[45] Date of Patent: Sep. 9, 1986

[54] COAXIAL CONNECTOR FOR ANTENNA

[75] Inventors: Erlon F. Johnson, Elizabethtown; Craig D. Richards, Boiling Springs, both of Pa.

[73] Assignee: AMP Incorporated, Harrisburg, Pa.

[21] Appl. No.: 619,089

[22] Filed: Jun. 8, 1984

[51] Int. Cl.[4] ..... H01Q 1/24

[52] U.S. Cl. ..... 343/702; 343/906; 339/177 R

[58] Field of Search ..... 174/152 A, 153 A; 343/702, 900, 906; 339/90 C, 177 R, 177 E

[56] References Cited

U.S. PATENT DOCUMENTS

| | | | |
|---|---|---|---|
| 3,453,376 | 7/1969 | Ziegler | 339/177 R |
| 3,789,418 | 1/1974 | Reiber et al. | 343/900 |
| 3,944,722 | 3/1976 | Larsen | 174/153 A |
| 4,165,911 | 8/1979 | Laudig | 339/90 C |
| 4,435,713 | 3/1984 | Gasparaitis et al. | 343/702 |
| 4,523,197 | 6/1985 | Imazeki et al. | 343/906 |

FOREIGN PATENT DOCUMENTS

| | | | |
|---|---|---|---|
| 1267291 | 9/1964 | Fed. Rep. of Germany | 343/702 |

*Primary Examiner*—Eli Lieberman

[57] ABSTRACT

A coaxial connector for connection to one end of an antenna comprises a metal shell including a coupling section for coupling the connector to a complementary coaxial connector. A dielectric member is disposed in the metal shell and secured therein enabling the metal shell and dielectric member to rotate relative to each other. A bore extending through the dielectric member has a front section of polygonal configuration along which a contact section of the center contact member extends and a rear section along which a theaded section of the center contact member forms threads in the rear section thereby securing the center contact member in the bore of the dielectric member while the polygonal front section engages a complementary holding member to maintain the dielectric stationary during threading of the threaded section into the rear section. An antenna-securing section of the center contact member extends outwardly from the threaded section onto which an end of an antenna is secured.

19 Claims, 5 Drawing Figures

COAXIAL CONNECTOR FOR ANTENNA

FIELD OF THE INVENTION

This invention relates to electrical connectors and more particularly to coaxial connectors for antennas.

BACKGROUND OF THE INVENTION

Antennas currently in use on walkie-talkie radios are in the form of a dielectric-coated spring that is electrically connected to a center contact member which is threadably mounted in a threaded hole of a dielectric insert secured in a metal shell. The metal shell also has another dielectric insert secured therein along a bore of which extends a contact section of the center contact member, and a bayonet coupling member is rotatably mounted on the metal shell to electrically connect the antenna onto a complementary coaxial connector on the radio.

This connector assembly has many components resulting in increased costs not only for parts but also in the manufacture thereof and it has a high profile.

SUMMARY OF THE INVENTION

According to the present invention, a coaxial connector for connection to one end of an antenna comprises a metal shell including a coupling section for coupling the connector to a complementary coaxial connector. A dielectric member is disposed in the metal shell and secured therein enabling the metal shell and dielectric member to rotate relative to each other. A bore extending through the dielectric member has a front section of polygonal configuration along which a contact section of the center contact member extends and a rear section along which a threaded section of the center contact member forms threads in the rear section thereby securing the center contact member in the bore of the dielectric member while the polygonal front section engages a complementary holding member to maintain the dielectric member stationary during threading of the threaded section into the rear section. An antenna-securing section of the center contact member extends outwardly from the threaded section onto which an end of an antenna is secured.

DETAILED DESCRIPTION OF THE INVENTION

Figure 1:
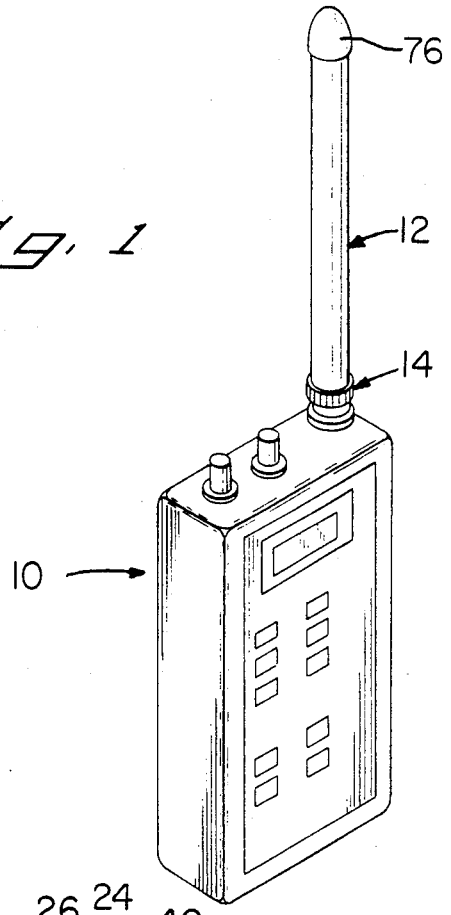
FIG. 1 is a perspective view of a walkie-talkie radio with an antenna connected thereto.
Figure 4:
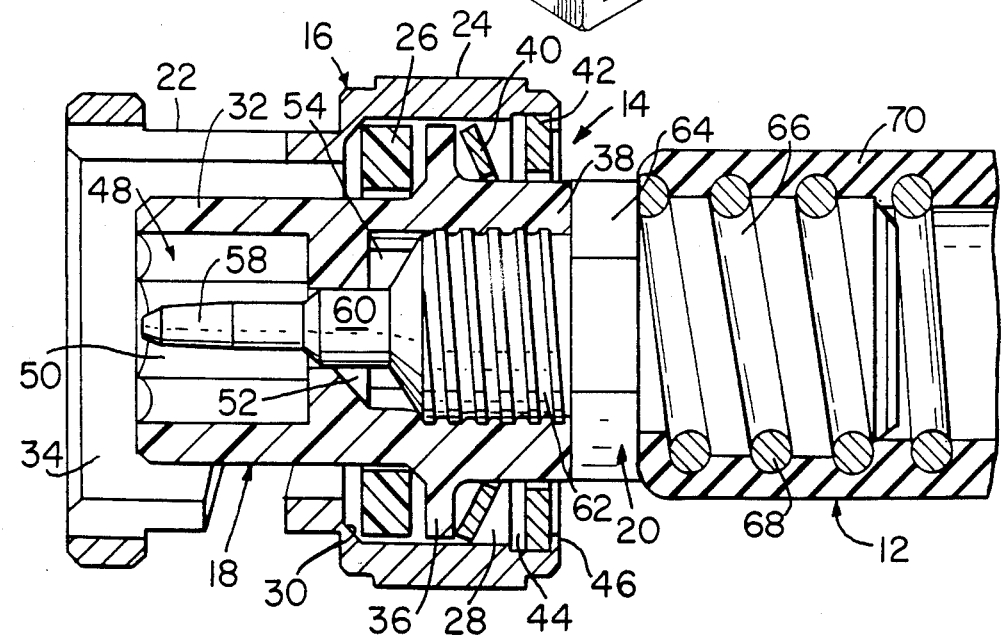
FIG. 4 is a view similar to FIG. 3 showing the connector in an assembled condition.
Figure 2:
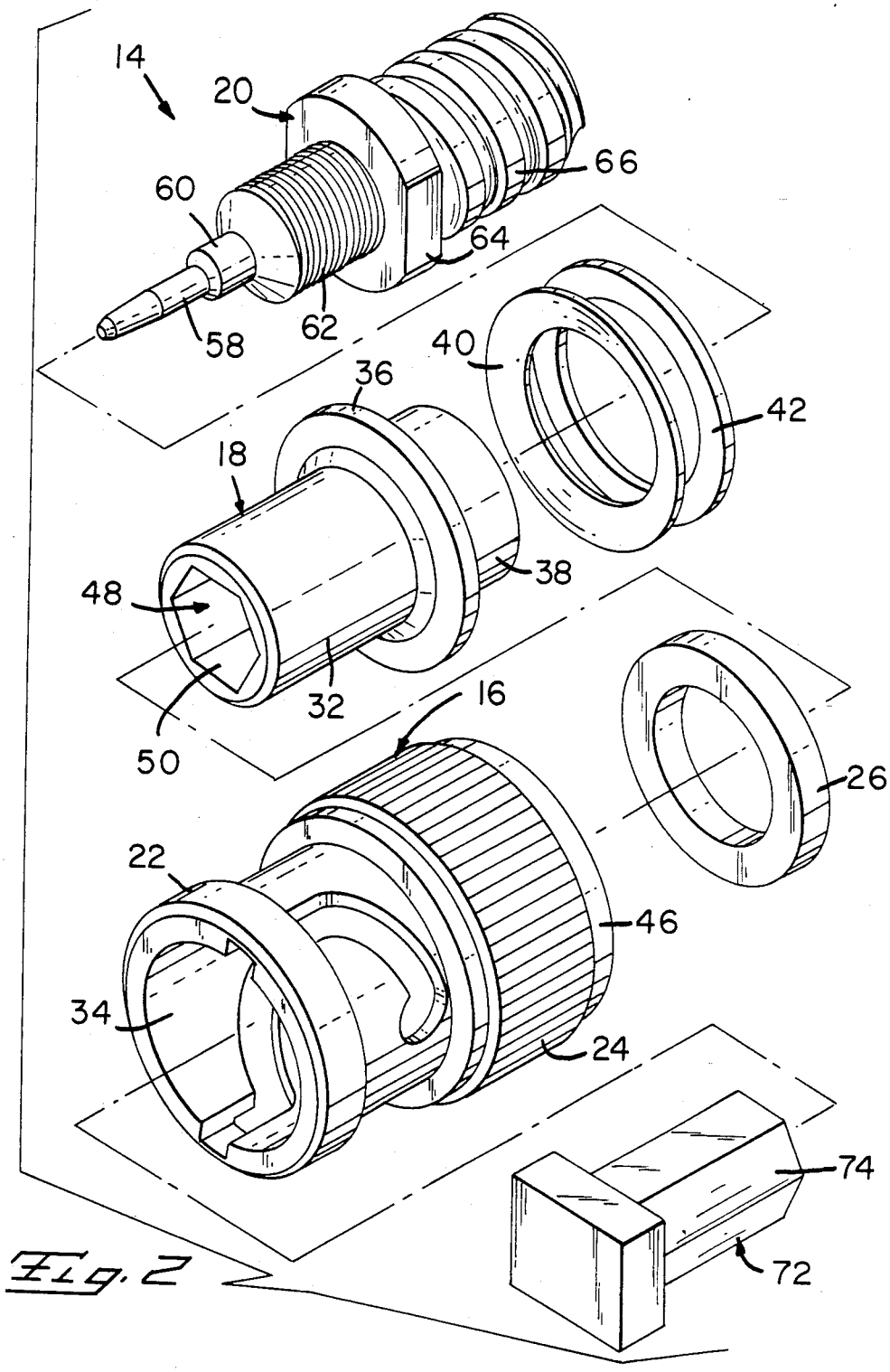
FIG. 2 is an exploded and perspective view of the components of a coaxial connector onto which an end of an antenna is to be secured.
Figures 3, 3A:
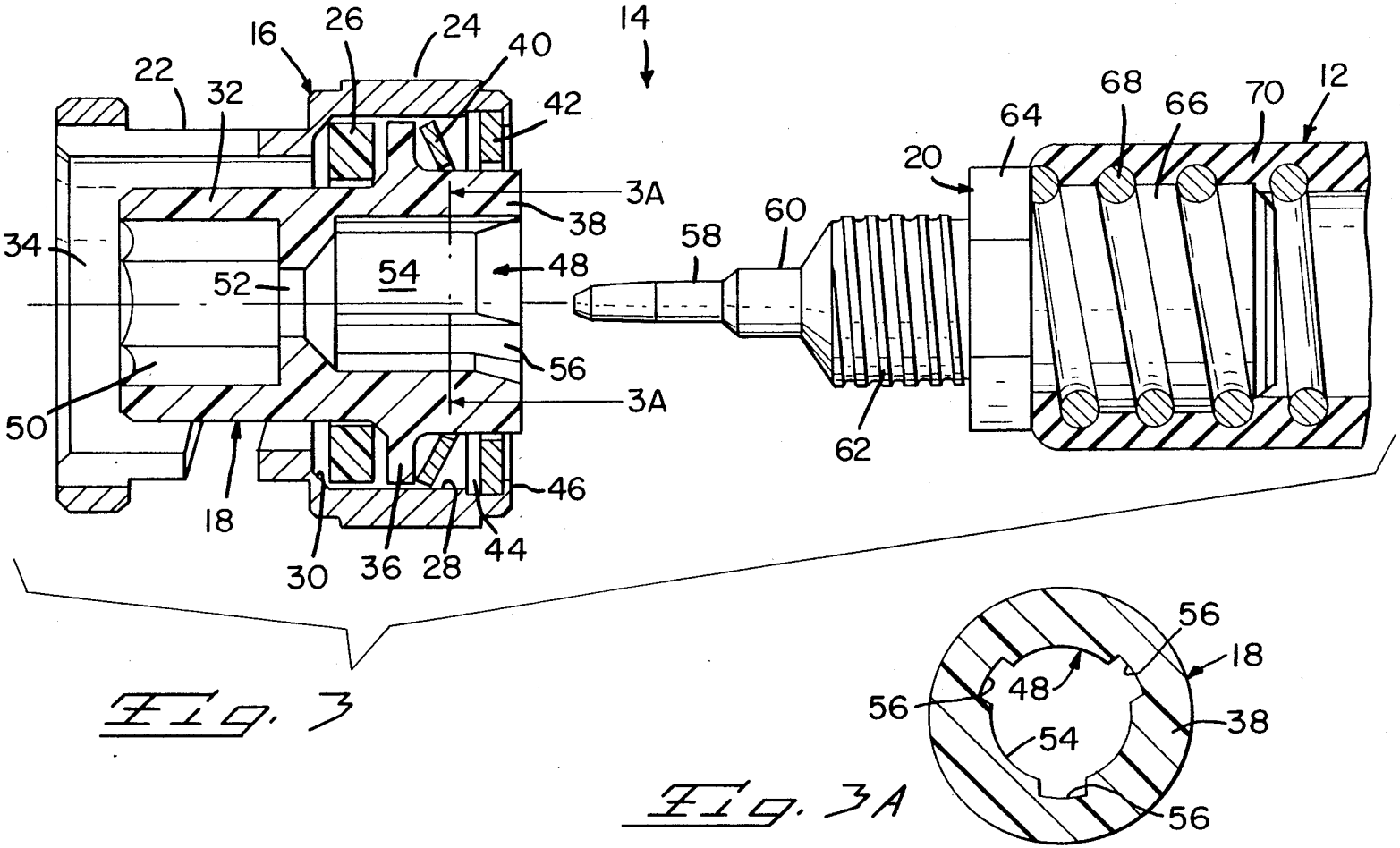
FIG. 3 is a cross-sectional view of a metal shell and dielectric assembly and a part cross-sectional view of a center contact member exploded from the metal shell and dielectric assembly with an end of an antenna secured to the antenna-securing section of the center contact member.
FIG. 3A is a cross-sectional view taken along line 3A—3A of FIG. 3.

FIG. 1 shows a radio 10 of the walkie-talkie type to which is electrically connected an antenna 12 via coaxial connector 14 which is of the BNC type and is electrically connected to radio 10 via a complementary coaxial connector (not shown). Coaxial connector 14 as shown in FIGS. 2 through 4 includes a metal shell 16, a dielectric member 18, and a center contact member 20. Dielectric member 18 is molded from any suitable dielectric material having the desirable dielectric characteristics.

Metal shell 16 includes a coupling section 22 of the bayonet type and a body section 24 the outer surface of which is knurled. An annular sealing gasket 26 is disposed along a bore 28 of body section 24 adjacent a beveled surface 30 thereof as shown in FIGS. 3 and 4.

A front section 32 of dielectic member 18 extends along part of bore 28 of body section 24 of metal shell 16 and also extends along an inner surface 34 of coupling section 22 in a coaxial manner. An annular flange 36 of dielectric member 18 is disposed along bore 28 of body section 24 of metal shell 16 as well as rear section 38 of dielectric member 18. An annular spring member 40 is disposed within bore 28 of body section 24 adjacent annular flange 36 and an annular washer 42 is disposed in annular recess 44 in communication with bore 28 and is secured therein by bending inwardly a thin section 46 of body section 24. In this way, metal shell 16 and dielectric member 18 are secured together as an assembly and are rotatable relative to one another.

A bore 48 extends through dielectric member 18 and includes a front section 50, a mid-section 52, and a rear section 54. Front section 50 has a polygonal configuration and is preferably hexagonal. Mid-section 52 has a front annular configuration and a rear beveled configuration, while rear section 54 is substantially annular but has recesses 56 disposed therein at 120° intervals therearound; however, more or less recesses 56 can be disposed in rear section 54 if desired. The entrances to front section 50 and rear section 54 are beveled. Rear section 38 of dielectric member 18 extends slightly beyond the rear end of metal shell 16 as shown in FIGS. 3 and 4.

Center contact member 20 includes contact section 58, mid-section 60, threaded section 62, nut section 64, and threaded contact section 66. Coil spring member 68 of antenna has one end threadedly mounted on threaded contact section 66 of center contact member 20 and is preferably soldered thereto. Coil spring member 68 is dipped into a plastisol or suitable dielectric coating material thereby coating spring member 68 including threaded contact section 66 to nut section 64 with a suitable dielectric material thereby forming an antenna subassembly which can now be secured in position in the metal shell subassembly which comprises metal shell 16 rotatably secured onto dielectric member 18.

The metal shell subassembly is mounted onto a holding jig 72 which includes a polygonal section 74 that mates with polygonal front section 50 of bore 48 of dielectric member 18 to hold dielectric member 18 stationary while center contact member 20 of the antenna subassembly is secured in bore 48 of dielectric member 18 via threaded section 62 of center contact member 20 being self-threaded into rear section 54 of bore 48 of dielectric member 18 via a wrench or the like engaging nut section 64 thereby self-tapping rear section 54. Recesses 56 enable parts of rear section 54 to be moved thereinto as well as any particles that are sheared off to ease the tapping of threaded section 62 along rear section 54. Threaded section 62 is thus self-tapped into rear section 54 until nut section 64 engages the rear surface of section 38 of dielectric member 18 thereby positioning mid-section 60 of center contact member 20 within mid-section 52 of dielectric member 18, and contact section 58 of center contact member 20 is disposed coaxially within front section 50 of dielectric member 18 as shown in FIG. 4 thereby completing the coaxial connector 14 with antenna 12 electrically connected thereto.

Polygonal section 74 of holding jig 72 is provided with a hole (not shown) to receive contact section 58 therein during the self-tapping of center contact member 20 within dielectric member 18 and this hole can be provided with a contact member which will be electrically connected with contact section 58 of center contact member 20 so that holding jig 72 also becomes a test fixture to test the electrical connector as well as to trim antenna 12 to its proper electrical length, whereafter a dielectric cap member 76, as shown in FIG. 1, can be secured onto dielectric coating 70 to complete the antenna assembly. Coaxial connector 14 as part of the antenna assembly can then be electrically connected to the complementary jack connector on radio 10 via bayonet coupling section 22 under the inference of spring member 40 with gasket 26 forming a seal therewith. Alternatively, coupling section 22 can be a threaded coupling section if desired.

While section 54 is preferably self-tapped by threaded section 62 of center contact member 20, section 54 can have threads therein when dielectric member 18 is molded, but this increases the cost of the mold and the cycle time for molding the dielectric members.

As can be discerned, a unique coaxial connector antenna assembly is disclosed that has a minumum number of parts, is readily assembled, can be tested and the antenna trimmed to precise length at a single location, is low profile and is cost effective.

We claim:

1. A coaxial connector for connection to one end of an antenna, comprising:

a metal shell including a coupling section for coupling the connector to a complementary coaxial connector;

a dielectric member disposed in the metal shell and having a front section and a rear section and a bore extending therethrough, said bore having a forward section of polygonal configuration and a rearward section;

means on said dielectric member and said metal shell securing said dielectric member in said metal shell for rotation relative to one another; and a center contact member having a forward contact section, a threaded section and a rear contact section on which an end of an antenna is secured, said center contact member being secured into said rear section of said dielectric member by screwing said threaded section into said rear section of said bore while said polygonal front section is held stationary on a complementary polygonal section of a holding member so that said forward contact section extends coaxially along said front section of said bore.

2. A coaxial connector as set forth in claim 1, wherein said coupling section is a bayonet type coupling section.

3. A coaxial connector as set forth in claim 1, wherein said securing means includes an annular flange on said dielectric member which is disposed in a bore of a body section of said metal shell, gasket means located in said bore forward of said flange and spring means in said bore rearward of said flange, and a washer in an annular recess of said bore with a rear end of said body section bent onto said washer.

4. A coaxial connector as set forth in claim 1, wherein said rearward section of said bore is annular and includes recesses therein to enable said threaded section of said center contact member to be self-tapped therein.

5. An electrical coaxial connector mounted on an antenna comprising, an antenna, a center contact portion of a coaxial connector mounted on an end of said antenna, a dielectric member concentrically surrounding said center contact portion, and a conductive coupling member rotatably mounted on said dielectric member, said center contact member having a contact section extending toward an open end of said dielectric member and toward an open end of said coupling member, the improvement comprising, said center contact member being threadably secured to said dielectric member and further being threadably secured to said end of said antenna, said antenna extending in free space externally of said coaxial connector toward a free end of the antenna that terminates in free space.

6. An electrical coaxial connector mounted on an antenna, as recited in claim 5, the improvement further comprising, an integral flange on said dielectric member and received in a rearward portion of said coupling member, and retaining means on said coupling member for retaining said flange for rotation in said rearward portion of said coupling member.

7. An electrical coaxial connector mounted on an antenna, as recited in claim 6, the improvement further comprising, said dielectric member having a polygonal section adjacent said open end.

8. An electrical coaxial connecter mounted on an antenna, as recited in claim 5, the improvement further comprising, said dielectric member having a polygonal section adjacent said open end.

9. An electrical coaxial connector mounted on an antenna, as recited in claim 8, the improvement further comprising, said center contact member having an externally threaded first section secured to said dielectric member and a threaded second section secured to said end of said antenna.

10. An electrical coaxial connector mounted on an antenna, as recited in claim 5, the improvement further comprising, said center contact member having an externally threaded first section secured to said dielectric member and a threaded second section secured to said end of said antenna.

11. An electrical coaxial connector mounted on an antenna, as recited in claim 6, the improvement further comprising, said center contact member having an externally threaded first section secured to said dielectric member and a threaded second section secured to said end of said antenna.

12. An electrical coaxial connector mounted on an antenna, as recited in claim 7, the improvement further comprising, said center contact member having an externally threaded first section secured to said dielectric member and a threaded second section secured to said end of said antenna.

13. An electrical coaxial connector mounted on an antenna, as recited in claim 12, the improvement further comprising, said center contact member having an enlarged section between said threaded first section and said threaded second section and constructed for engagement by a wrench tool.

14. An electrical coaxial connector mounted on an antenna, as recited in claim 12, the improvement further comprising, said center contact member having an enlarged section between said threaded first section and said threaded second section and constructed for engagement by a wrench tool.

15. An electrical coaxial connector mounted on an antenna, as recited in claim 10, the improvement further comprising, said center contact member having an enlarged section between said threaded first section and said threaded second section and constructed for engagement by a wrench tool.

16. An electrical coaxial connector mounted on an antenna, as recited in claim 9, the improvement further comprising, said center contact member having an enlarged section between said threaded first section and said threaded second section and constructed for engagement by a wrench tool.

17. An electrical coaxial connector mounted on an antenna, as recited in claim 5, the improvement further comprising, said center contact member having an enlarged section between said antenna and said dielectric member and constructed for engagement by a wrench tool.

18. An electrical coaxial connector mounted on an antenna, as recited in claim 6, the improvement further comprising, said center contact member having an enlarged section between said antenna and said dielectric member and constructed for engagement by a wrench tool.

19. An electrical coaxial connector mounted on an antenna, as recited in claim 7, the improvement further comprising, said center contact member having an enlarged section between said antenna and said dielectric member and constructed for engagement by a wrench tool.

* * * * *